US006720947B2

(12) United States Patent
Yoo et al.

(10) Patent No.: US 6,720,947 B2
(45) Date of Patent: Apr. 13, 2004

(54) METHOD FOR DRIVING AN ANTI-FERROELECTRIC LIQUID CRYSTAL DISPLAY PANEL

(75) Inventors: Jeong-geun Yoo, Anyang (KR); Sergel Yukovenko, Suwon (KR)

(73) Assignee: Samsung SDI Co., Ltd., Suwon (KR)

( * ) Notice: Subject to any disclaimer, the term of this patent is extended or adjusted under 35 U.S.C. 154(b) by 268 days.

(21) Appl. No.: 09/837,479

(22) Filed: Apr. 19, 2001

(65) Prior Publication Data

US 2002/0011977 A1 Jan. 31, 2002

(30) Foreign Application Priority Data

Jun. 9, 2000 (KR) ..... 2000-31658

(51) Int. Cl.[7] ..... G09G 3/36
(52) U.S. Cl. ..... 345/97; 345/99
(58) Field of Search ..... 345/87, 95, 96, 345/97, 89, 99

(56) References Cited

U.S. PATENT DOCUMENTS 5,440,412 A * 8/1995 Mouri et al. ..... 345/96
5,459,481 A * 10/1995 Tanaka et al. ..... 345/95
5,521,727 A * 5/1996 Inaba et al. ..... 345/89
5,838,293 A * 11/1998 Kondoh ..... 345/97
5,945,971 A * 8/1999 Imoto et al. ..... 345/97
6,008,787 A * 12/1999 Kondoh ..... 345/97
6,175,350 B1 * 1/2001 Green ..... 345/96
6,271,819 B1 * 8/2001 Fujita ..... 345/95
6,313,820 B1 * 11/2001 Helbing et al. ..... 345/96
6,339,416 B1 * 1/2002 Kondoh ..... 345/97
6,509,887 B1 * 1/2003 Kondoh et al. ..... 345/87

FOREIGN PATENT DOCUMENTS

JP 2000-111878 4/2000

* cited by examiner

*Primary Examiner*—Steven Saras
*Assistant Examiner*—Uchendu O. Anyaso
(74) *Attorney, Agent, or Firm*—McGuireWoods LLP

(57) ABSTRACT

A method for driving an anti-ferroelectric liquid crystal display (LCD) panel in which a plurality of parallel signal electrode lines are arranged over anti-ferroelectric liquid crystal cells (LCs) and a plurality of parallel scan electrode lines are arranged below the anti-ferroelectric LCs, perpendicular to the signal electrode lines is provided. The method includes the steps of selectively shifting LCs into a ferroelectric state, keeping the selected LCs in the ferroelectric state, activating the selected LCs, and restoring the activated LCs to an anti-ferroelectric state. In particular, a scan selection voltage is applied to a scan electrode lines to be scanned, and a display data signal is applied to all of the signal electrode lines, to selectively shift LCs into a ferroelectric state. Next, a holding voltage, which is lower than the scan selection voltage and has the same polarity, is applied to the scan electrode line for a predetermined period of time, to keep the selected LCs in the ferroelectric state. Alternating current (AC) pulses, each having opposite polarities and a voltage lower than the scan selection voltage, are applied to the scan electrode line, to activate the selected LCs. Then, ground voltage is applied to the scan electrode line to restore the activated LCs to an anti-ferroelectric state.

2 Claims, 4 Drawing Sheets

METHOD FOR DRIVING AN ANTI-FERROELECTRIC LIQUID CRYSTAL DISPLAY PANEL

BACKGROUND OF THE INVENTION

1. Field of the Invention

The present invention relates to a method for driving an anti-ferroelectric liquid crystal display (LCD) panel, and more particularly, to a method for driving an anti-ferroelectric LCD panel in which a plurality of parallel signal electrode lines are arranged over anti-ferroelectric liquid crystal cells (LCs), and a plurality of parallel scan electrode lines are arranged below the anti-ferroelectric LCs, perpendicular to the signal electrode lines.

2. Description of the Related Art

Referring to FIG. 1, a general anti-ferroelectric LCD 1 includes an anti-ferroelectric LCD panel 11 and a driving apparatus thereof. The anti-ferroelectric LCD panel 11 has a series of parallel signal electrode lines SL1, SL2, SL3, . . . , SLn arranged over anti-ferroelectric LCs, and a series of parallel scan electrode lines CL1, CL2, CL3, . . . , CLm arranged below the anti-ferroelectric LCs, wherein the signal electrode lines SL1, SL2, SL3, . . . , SLn are perpendicular to the scan signal electrode lines CL1, CL2, CL3, . . . , CLm. The signal electrode lines SL1, SL2, SL3, . . . , SLn and the scan electrode lines CL1, CL2, CL3, . . . , CLm are formed of a transparent conductive material, for example, indium tin oxide (ITO).

As shown in FIG. 1, the driving apparatus includes a segment driver 12, a modulation signal generator 131 and a common driver 132. The driving apparatus receives a data signal DATA, a shift clock signal SCK, a frame signal FLM and a latch clock signal LCK from a host, for example, from a notebook computer. The segment driver 12 stores the received data signal for each of the signal electrode lines SL1, SL2, SL3, . . . , SLn, according to the shift clock signal SCK. The segment driver 12 applies a signal voltage corresponding to the stored data signal DATA to each of the signal electrode lines SL1, SL2, SL3, . . . , SLn according to the latch clock signal LCK.

The frame signal FLM indicates the starting point of a frame. The modulation signal generator 131 divides the frequency of the latch clock signal LCK to generate a modulation signal. The polarity of the output voltages from the segment driver 12 and the common driver 132 are controlled by the modulation signal.

The common driver 132 applies a corresponding scan voltage to each of the scan electrode lines CL1, CL2, CL3, . . . , CLm in succession according to the controls of the latch clock signal LCK, the frame signal FLM and the modulation signal. As a result, the orientation state of the anti-ferroelectric LCs of a pixel to be displayed is shifted, thereby transmitting light or blocking the transmission of light.

FIG. 2 illustrates the waveform of a common drive voltage applied to a scan electrode line by a conventional driving method.

Referring to FIG. 2, during a first selection period $t_{s1}$ corresponding to a unit slot (SL), a scanning selection voltage $+V_s$ is applied, and the orientation state of anti-ferroelectric LCs selected depending on a corresponding display data signal $S_s$ are shifted into a ferro-electric state, which allows transmission of light from the outside. During the subsequent first holding period $t_{H1}$, a holding voltage $+V_H$, which has the same polarity as the scanning selection voltage $+V_s$, but its level is lower than that of the scanning selection voltage $+V_s$, is applied, and the selected LCs are maintained in the ferroelectric state. During the subsequent first reset period $t_{R1}$, ground voltage is applied and the LCs are restored to the anti-ferroelectric state from the ferroelectric state. The first reset period $t_{R1}$ is required for smooth inverse driving during the subsequent unit driving period.

During the subsequent second selection period $t_{S2}$, a scanning selection voltage $-V_S$ is applied and anti-ferroelectric LCs selected depending on a corresponding display data signal $S_s$ are shifted into the ferroelectric state, which allows transmission of light from the outside. During the subsequent second holding period $t_{H2}$, a holding voltage $-V_H$, which has the same polarity as the scanning selection voltage $-V_s$, but its level is higher than that of the scanning selection voltage $-V_s$, is applied and the selected LCs are maintained in the ferroelectric state. During the subsequent second reset period $t_{R2}$, ground voltage is applied and the LCs are restored to the anti-ferroelectric state from the ferroelectric state. The second reset period $t_{R2}$ is required for smooth inverse driving of the subsequent unit driving period.

FIG. 3 shows the change of transmittancy of the selected LCs during the first or second reset period $t_{R1}$ or $t_{R2}$ of FIG. 2. In FIG. 3, reference numeral 31 indicates a circular waveform in the state where a probe voltage is not applied, and reference numerals 311, 312, 313 and 314 indicate interference waveforms when the probe voltage is applied. As described with reference to FIG. 2, during the first or second reset period $t_{R1}$ or $t_{R2}$, the level of voltage applied to a scanning electrode line is changed from the holding voltage $+V_H$ or $-V_H$ to ground voltage, so that the selected LCs in the ferroelectric state are restored to the anti-ferroelectric state. As a result, light transmittancy of the selected LCs is lowered, as shown in FIG. 3.

In anti-ferroelectric LCD panels, brightness increases with a rising state restoration time in the selected LCs. However, when an anti-ferroelectric LCD panel is simply driven by the conventional method as illustrated in FIG. 2, it takes a long period of time to restore the orientation state of LCs in the first or second reset period $t_{R1}$ or $t_{R2}$, and thus brightness of the anti-ferroelectric LCD panel decreases.

FIG. 4 illustrates the waveform of a common drive voltage applied to a scan electrode line by another conventional driving method. In FIG. 4, like reference numerals are used to refer to like operations of FIG. 2. Compared with FIG. 2, the driving waveform of FIG. 4 further includes single activation periods $t_{B1}$, and $t_{B2}$, for which a single blanking pulse is applied, between the first holding period $t_{H1}$ and the first reset period $t_{R1}$, and between the second holding period $t_{H2}$ and the second reset period $t_{R2}$.

FIG. 5 illustrates the change of transmittancy of the selected LCs during the first and second reset periods $t_{R1}$ and $t_{R2}$. In FIG. 5, reference numeral 51 indicates a non-active waveform that appears when applying the driving method of FIG. 2. Reference numeral 521 indicates an active waveform that appears when applying the driving method of FIG. 4, and reference numerals 522 and 523 indicate interference waveforms when the probe voltage is applied. As shown in FIG. 5, the state restoration time becomes short due to the presence of the single activation periods $t_{B1\ and\ tB2}$ during each of which the signal blanking pulse is applied.

However, when the driving method of FIG. 4 is applied, the state restoration is sensitive to temperature variations. In other words, when the neighboring temperature is higher or lower than room temperature, the single blanking pulse applied during each of the single activation periods $t_{B1}$, and $t_{B2}$ acts as a noise component, so that the state restoration time cannot be reduced.

SUMMARY OF THE INVENTION

To solve the above problems, it is an objective of the present invention to provide a method for driving an anti-ferroelectric liquid crystal display (LCD) panel, which can consistently reduce the time required for restoring the state in liquid crystal cells, regardless of ambient temperature changes.

To achieve the objective of the present invention, there is provided a method for driving an anti-ferroelectric liquid crystal display (LCD) panel in which a plurality of parallel signal electrode lines are arranged over anti-ferroelectric liquid crystal cells (LCs) and a plurality of parallel scan electrode lines are arranged below the anti-ferroelectric LCs, perpendicular to the signal electrode lines, the method comprising the steps of selectively shifting LCs into a ferroelectric state, keeping the selected LCs in the ferroelectric state, activating the selected LCs, and restoring the activated LCs to an anti-ferroelectric state.

In particular, a scan selection voltage is applied to a scan electrode lines to be scanned, and a display data signal is applied to all of the signal electrode lines, to selectively shift LCs into a ferroelectric state. Next, a holding voltage, which is lower than the scan selection voltage and has the same polarity, is applied to the scan electrode line for a predetermined period of time, to keep the selected LCs in the ferroelectric state. Alternating current (AC) pulses, each having inverted polarity and a voltage lower than the scan selection voltage, are applied to the scan electrode line, to activate the selected LCs. Then, ground voltage is applied to the scan electrode line to restore the activated LCs to an anti-ferroelectric state.

According to the inventive method for driving an anti-ferroelectric LCD panel, in the step of activating the selected LCs, AC pulses, each having inverted polarity and a voltage lower than the scan selection voltage, are applied to the scan electrode lines. As a result, the time required for restoring the state of LCs can be reduced with consistency regardless of temperature changes. The alternating current (AC) pulses are generated by switching DC voltages such as $+V_S$, $+V_H$, ground voltage, $-V_S$ and $-V_H$. The width of each of the AC pulses corresponds to the length of time taken to switch the DC voltages.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

Figure 1:
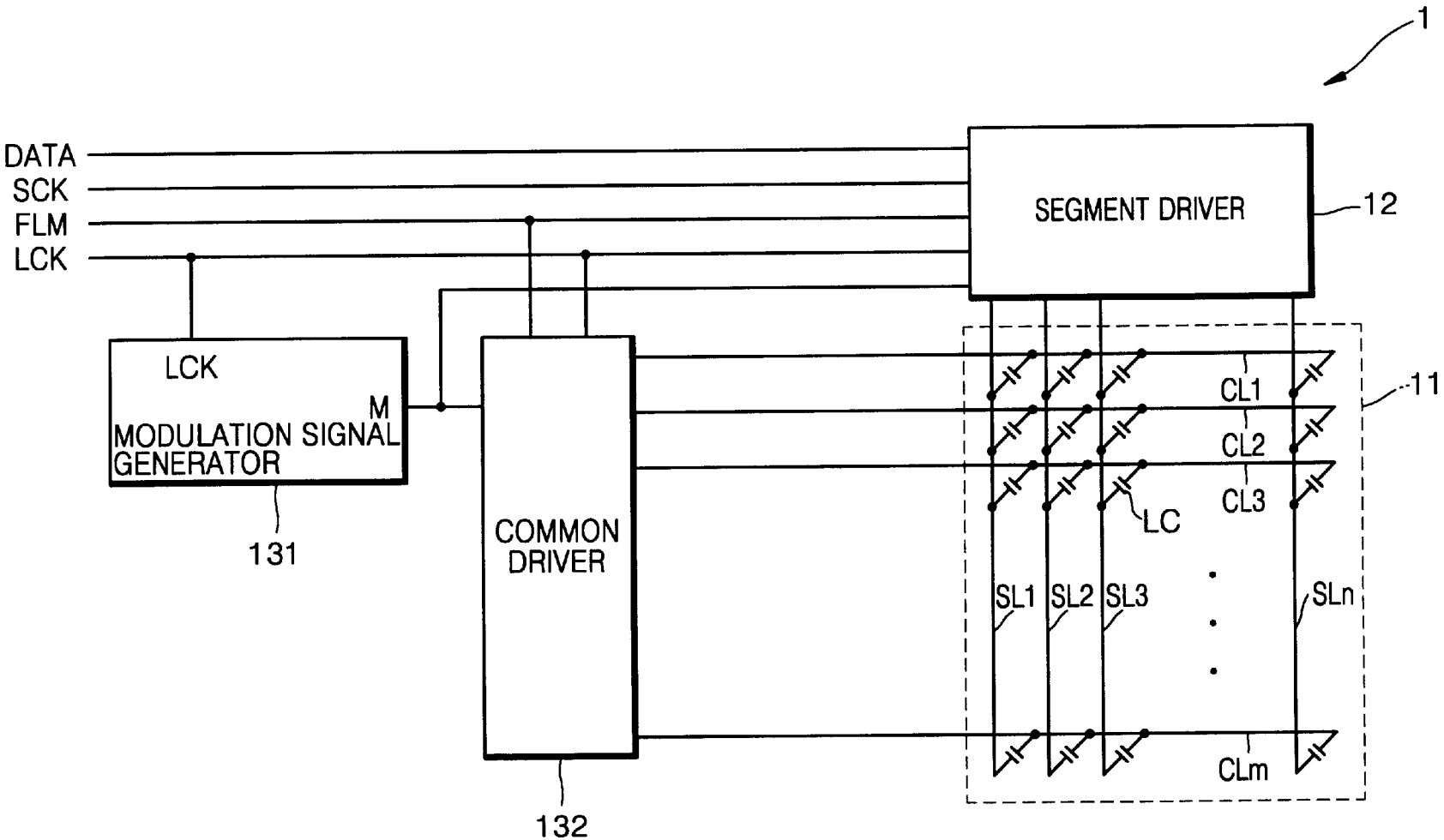
FIG. 1 is a block diagram of a general anti-ferroelectric liquid crystal display (LCD)

In an anti-ferroelectric liquid crystal display (LCD) panel to which an embodiment of the inventive driving method is applied, as illustrated in FIG. 1, a plurality of parallel signal electrode lines SL1, SL2, SL3, . . . , SLn are arranged over anti-ferroelectric liquid crystal cells (LCs), and a plurality of parallel scan electrode lines CL1, CL2, . . . , CLm are arranged below the anti-ferroelectric LCs, perpendicular to the signal electrode lines SL1, SL2, SL3, . . . , SLn.

Figure 6:
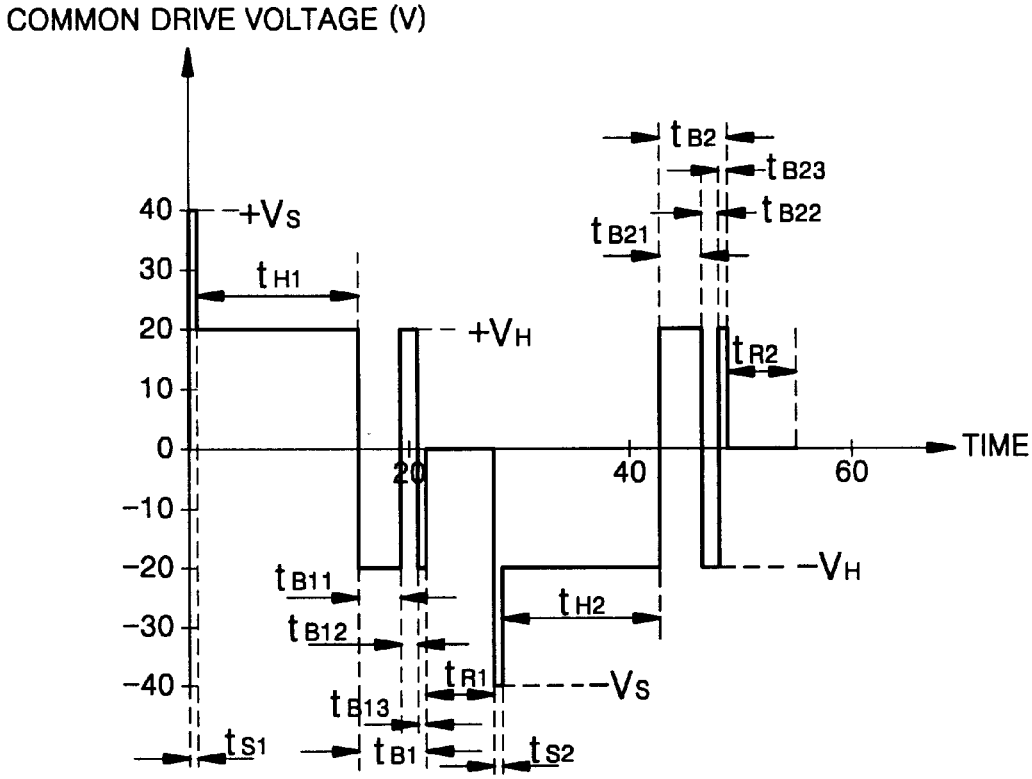
FIG. 6 illustrates the waveform of a common driving voltage applied to a scan electrode line by a driving method according to the present invention.

FIG. 6 illustrates the waveform of a common driving voltage applied to a scan electrode line by a driving method according to a preferred embodiment of the present invention.

As shown in FIG. 6, one unit driving period has the opposite polarity to the other neighboring unit driving period. The unit driving period includes a selection period $t_{s1}$, or $t_{s2}$, a holding period $t_{H1}$ or $t_{H2}$, an activation period $t_{B1}$ or $t_{B2}$, and a reset period $t_{R1}$ or $t_{R2}$.

Figure 2:
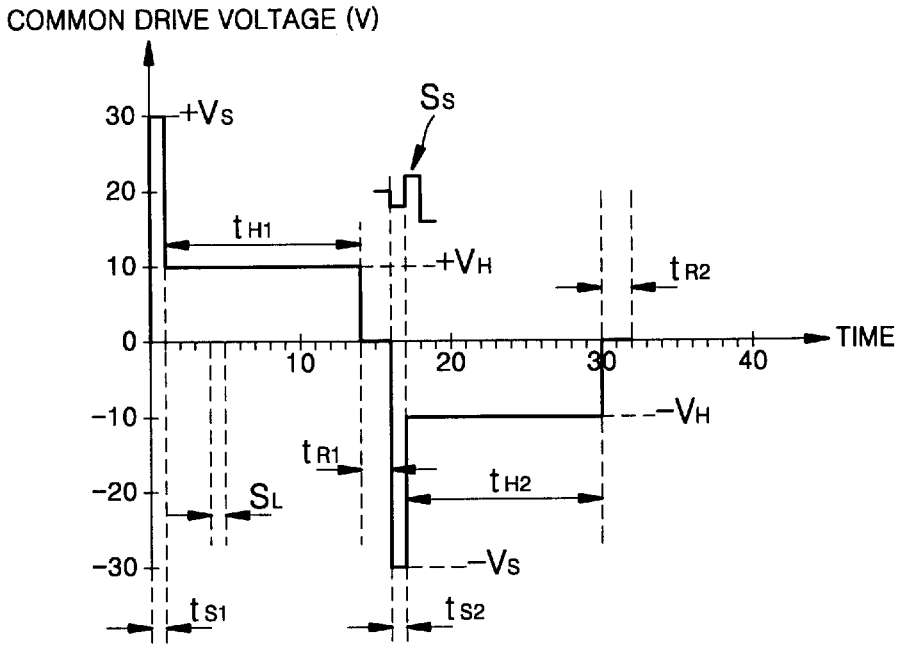
FIG. 2 (PRIOR ART)
FIG. 2 illustrates the waveform of a common driving voltage applied to a scan electrode line by a conventional driving method.
Figure 3:
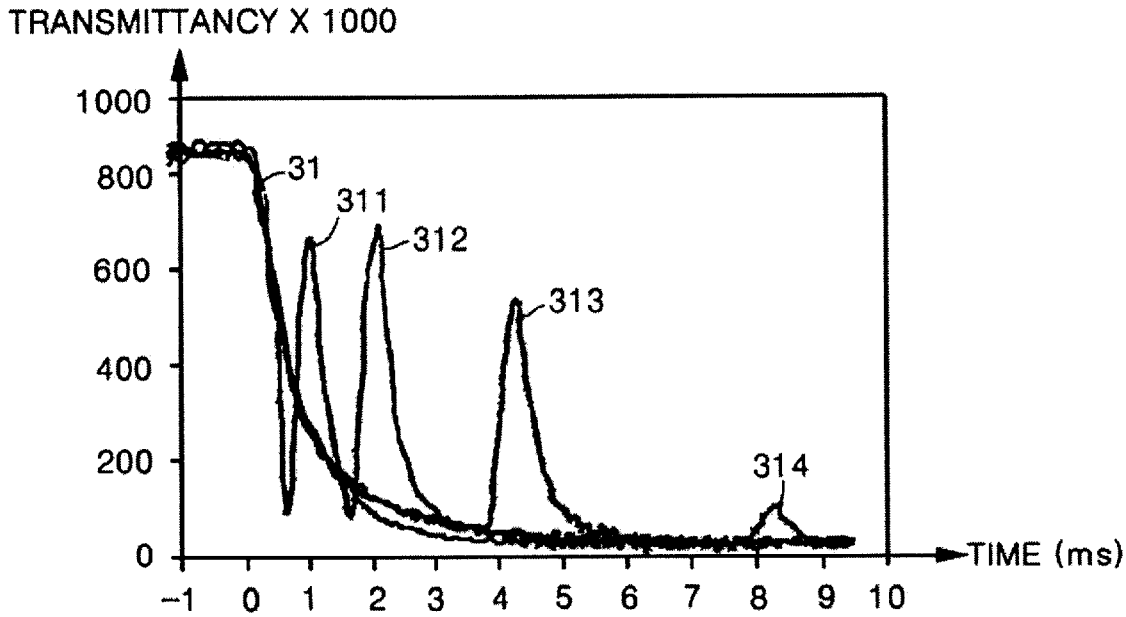
FIG. 3 (PRIOR ART)
FIG. 3 illustrates the change in transmittancy of selected liquid crystal-cells (LCs) in the first or second reset period of FIG. 2.
Figure 4:
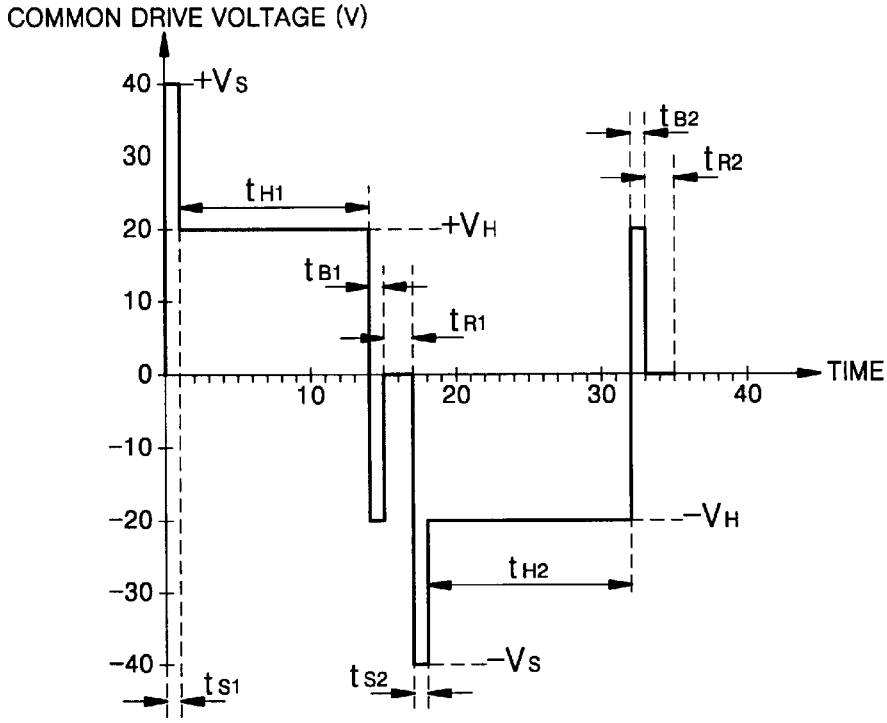
FIG. 4 (PRIOR ART)
FIG. 4 illustrates the waveform of a common driving voltage applied to a scan electrode line by another conventional driving method.
Figure 5:
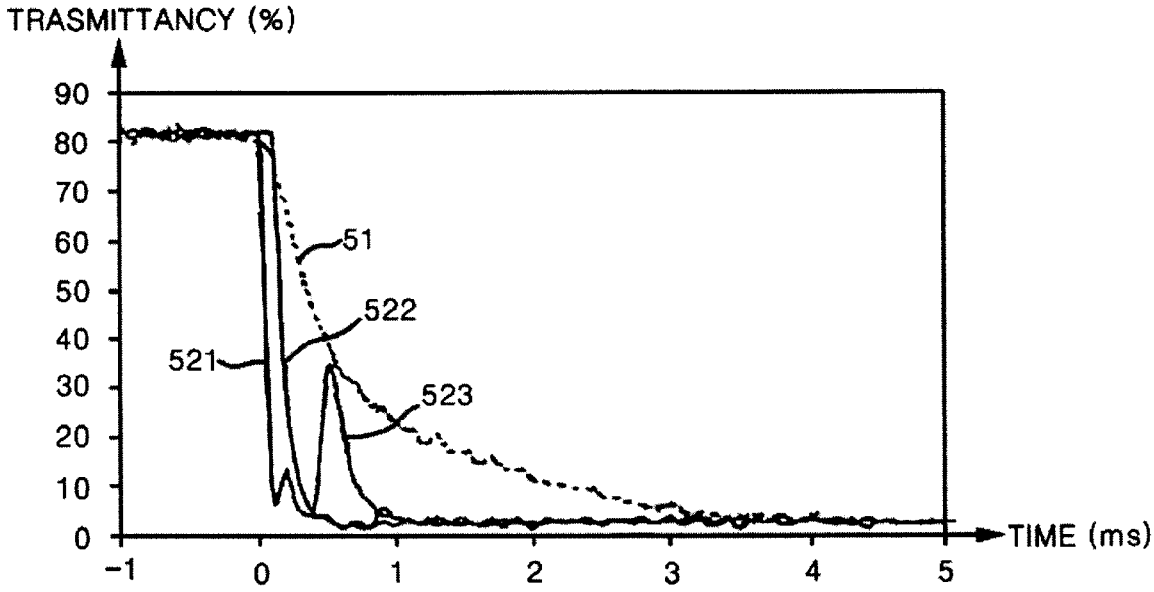
FIG. 5 (PRIOR ART)
FIG. 5 illustrates the change in transmittancy of selected LCs in the first and second reset periods of FIG. 4.

During the first selection period $t_{s1}$, corresponding to one unit slot $S_L$ (see FIG. 2), a scanning selection voltage $+V_s$ is applied to a scan electrode line. The selected anti-ferroelectric LCs are shifted to the ferroelectric state, according to the corresponding display data signal voltage $S_s$ (see FIG. 2). This allows transmission of light from the outside. During the subsequent first holding period $t_{H1}$, a holding voltage $+V_H$, is applied. The holding voltage $+V_H$, has the same polarity as the scanning selection voltage $+V_s$, but its level is lower than the scanning selection voltage $+V_s$. The selected LCs are maintained in the ferroelectric state.

During the subsequent first activation period $t_{B1}$, alternating current (AC) pulses are applied to the scan electrode line for the first sub-activation period $t_{B11}$, the second sub-activation period $t_{B12}$ and the third sub-activation period $t_{B13}$, with opposite polarities, thereby activating the selected LCs. Here, the voltage level of the AC pulses applied to the scan electrode line for the first activation period $t_{B1}$ is lower than the scanning selection voltage $+V_s$, and equal to the holding voltage $+V_H$. The periods of each of the AC pulses, become shorter in the order of $t_{B11}$, $t_{B12}$ and $t_{B13}$. It has been found that, when a ratio of the pulse periods among $t_{B11}$, $t_{B12}$ and $t_{B13}$ was 3:2:1, the state restoration characteristics were superior. In the present embodiment, three unit slots ($3S_L$) are allocated for the first sub-activation period $t_{B11}$, two unit slots ($2S_L$) are allocated for the second sub-activation period $t_{B12}$, and one unit slot ($S_L$) is allocated for the third sub-activation period $t_{B13}$.

The values of parameters applied for the first activation period $t_{B1}$, including the three sub-activation periods $t_{B11}$, $t_{B12}$ and $t_{B13}$, are listed in Table 1.

TABLE 1

| Parameter | Value |
|---|---|
| $t_{B11}$ | $3\ S_L$ |
| $V_{B11}$ | $-V_H$ |
| $t_{B12}$ | $2\ S_L$ |
| $V_{B12}$ | $+V_H$ |
| $t_{B13}$ | $S_L$ |
| $V_{B13}$ | $-V_H$ |

In Table 1, $V_{B11}$ indicates the voltage of a first blanking pulse for the first sub-activation period $t_{B11}$, $V_{B12}$ indicates the voltage of a second blanking pulse for the second sub-activation period $t_{B12}$, and $V_{B13}$ indicates the voltage of a third blanking pulse for the third sub-activation period $t_{B13}$.

During the subsequent first reset period $t_{R1}$, ground voltage is applied to the scan electrode line, and the LCs in the ferroelectric state are restored to the anti-ferroelectric state. The three sub-activation periods $t_{B11}$, $t_{B12}$ and $t_{B13}$, can reduce the time required for restoration of state in the LCs with consistency, although the temperature changes. Satisfactory results can be obtained when four unit slots $4S_L$ are allocated for the first reset period $t_{R1}$.

During the second selection period $t_{S2}$ corresponding to one unit slot $S_L$, a scan selection voltage $-V_s$ is applied to the scan electrode line. Anti-ferroelectric LCs selected according to a corresponding display data signal voltage $S_s$ (see FIG. 2) are shifted to the ferroelectric state, which allows transmission of light from the outside. During the subsequent second holding period $t_{H2}$, a holding voltage $-V_H$ is applied. The holding voltage $-V_H$ has the same polarity as the scanning selection voltage $-V_s$, but a higher level than the scanning selection voltage $-V_s$. The selected LCs are maintained in the ferroelectric state.

During the subsequent second activation period $t_{B2}$, alternating current (AC) pulses are applied to the scan electrode line for the first sub-activation period $t_{B21}$, the second sub-activation period $t_{B22}$ and the third sub-activation period $t_{B23}$, with opposite polarities, thereby activating the selected LCs. Here, the voltage level of the AC pulses applied to the scan electrode line for the first activation period $t_{B2}$ is higher than the scanning selection voltage $-V_s$, and equal to the holding voltage $-V_H$. The periods of each of the AC pulses, becomes shorter in the order of $t_{B21}$, $t_{B22}$ and $t_{B23}$. In the present embodiment, three unit slots ($3S_L$) are allocated for the first sub-activation period $t_{B21}$, two unit slots ($2S_L$) are allocated for the second sub-activation period $t_{B22}$, and one unit slot ($S_L$) is allocated for the third sub-activation period $t_{B23}$.

The values of parameters applied for the first activation period $t_{B2}$, including the three sub-activation periods $t_{B21}$, $t_{B22}$ and $t_{B23}$, are listed in Table 2.

TABLE 2

| Parameter | Value |
|---|---|
| $t_{B21}$ | $3\ S_L$ |
| $V_{B21}$ | $+V_H$ |
| $t_{B22}$ | $2\ S_L$ |
| $V_{B22}$ | $-V_H$ |
| $t_{B23}$ | $S_L$ |
| $V_{B23}$ | $+V_H$ |

In Table 2, $V_{B21}$ indicates the voltage of a first blanking pulse for the first sub-activation period $t_{B21}$, $V_{B22}$ indicates the voltage of a second blanking pulse for the second sub-activation period $t_{B22}$, and $V_{B23}$ indicates the voltage of a third blanking pulse for the third sub-activation period $t_{B23}$.

During the subsequent second reset period $t_{R2}$, ground voltage is applied to the scan electrode line, and the LCs in the ferroelectric state are restored to the anti-ferroelectric state. The three sub-activation periods $t_{B21}$, $t_{B22}$ and $t_{B23}$, can reduce the time required for restoration of state in the LCs can be reduced with consistency, although the neighboring temperature changes. In the same manner as for the first reset period $t_{R1}$, four unit slots $4S_L$ are allocated for the second reset period $t_{R2}$.

As previously described, in the method for driving an anti-ferroelectric LCD panel according to the present invention, during the first and second activation periods $t_{B1}$ and $t_{B2}$, AC pulses with a voltage level lower than the scan selection voltage $+V_s$ or $-V_s$ are applied to a scan electrode line alternately with opposite polarities during the sub-activation periods. As a result, the time required for restoring the state of LCs can be reduced with consistency regardless of temperature changes.

While this invention has been particularly shown and described with reference to preferred embodiments thereof, it will be understood by those skilled in the art that various changes in form and details may be made thereto without departing from the spirit and scope of the invention as defined by the appended claims.

What is claimed is:

1. A method for driving an anti-ferroelectric liquid crystal display (LCD) panel having a plurality of parallel signal electrode lines arranged over anti-ferroelectric liquid crystal cells (LCs) and a plurality of parallel scan electrode lines arranged below the anti-ferroelectric LCs, perpendicular to the signal electrode lines, the method comprising steps of:

applying a scan selection voltage to a scan electrode line, and display data signals to the signal electrode lines, in order to selectively shift LCs into a ferroelectric state;

applying a holding voltage to the scan electrode line to keep the selected LCs in the ferroelectric state;

applying alternating current (AC) pulses for consecutive periods of time to the scan electrode line in order to activate the selected LCs; and applying a ground voltage to the scan electrode line to restore the activated LCs to an anti-ferroelectric state, wherein the periods of time for the AC pulses decrease consecutively.

2. A method for driving an anti-ferroelectric liquid crystal display (LCD) panel having a plurality of parallel signal electrode lines arranged over anti-ferroelectric liquid crystal cells (LCs) and a plurality of parallel scan electrode lines arranged below the anti-ferroelectric LCs, perpendicular to the signal electrode lines, the method comprising steps of:

applying a scan selection voltage to a scan electrode line, and display data signals to the signal electrode lines, in order to selectively shift LCs into a ferroelectric state;

applying a holding voltage to the scan electrode line to keep the selected LCs in the ferroelectric state;

applying alternating current (AC) pulses for consecutive periods of time to the scan electrode line in order to activate the selected LCs; and applying a ground voltage to the scan electrode line to restore the activated LCs to an anti-ferroelectric state, wherein the AC pulses include a first pulse having the opposite polarity to the holding voltage, a second pulse having the opposite polarity to the first pulse, and a third pulse having the opposite polarity to the second pulse, and a ratio of the periods among the first, second and third pulse is 3:2:1.

* * * * *

UNITED STATES PATENT AND TRADEMARK OFFICE

CERTIFICATE OF CORRECTION

PATENT NO. : 6,720,947 B2
DATED : April 13, 2004
INVENTOR(S) : Jeong-Geun Yoo et al.

It is certified that error appears in the above-identified patent and that said Letters Patent is hereby corrected as shown below:

Title page,
Item [75], Inventors, delete "Sergel Yukovenko" and insert -- Sergei Yakovenko --

Signed and Sealed this

Twenty-fifth Day of May, 2004

JON W. DUDAS
*Acting Director of the United States Patent and Trademark Office*